US011160338B2

(12) United States Patent
Martinez

(10) Patent No.: US 11,160,338 B2
(45) Date of Patent: Nov. 2, 2021

(54) ARTICLE OF ADORNMENT WITH INTERCHANGEABLE PARTS

(71) Applicant: Paul Aurelio Martinez, Morgan Hill, CA (US)

(72) Inventor: Paul Aurelio Martinez, Morgan Hill, CA (US)

( * ) Notice: Subject to any disclaimer, the term of this patent is extended or adjusted under 35 U.S.C. 154(b) by 79 days.

(21) Appl. No.: 16/211,189

(22) Filed: Dec. 5, 2018

(65) Prior Publication Data

US 2020/0178656 A1 Jun. 11, 2020

(51) Int. Cl.

| | |
|---|---|
| ***A44C 5/14*** | (2006.01) |
| ***A44C 13/00*** | (2006.01) |
| ***A44C 5/00*** | (2006.01) |
| ***A44C 15/00*** | (2006.01) |
| ***A44C 5/18*** | (2006.01) |

(52) U.S. Cl.

CPC ..... *A44C 13/00* (2013.01); *A44C 5/003* (2013.01); *A44C 5/18* (2013.01); *A44C 15/004* (2013.01); *A44D 2203/00* (2013.01); *A44D 2205/00* (2013.01)

(58) Field of Classification Search

CPC ..... A44C 5/00; A44C 5/0053; A44C 5/0061; A44C 5/185; A44C 5/20; A44C 5/2071; A44C 13/00; A44C 5/003; A44C 5/18; A44C 15/004; A44C 5/14; A44C 5/0007; A44D 2203/00; A44D 2205/00; G04B 37/1486; G04B 37/16; G04B 37/18; Y10T 24/4782; Y10T 24/4718; Y10T 24/47; Y10T 24/3401; Y10T 24/51; Y10T 24/45063

USPC ..... 63/3, 3.1, 3.2, 9, 11, 21–23; 368/281, 368/282; 224/164, 167, 178, 179, 219; 24/265 WS; D11/3, 4, 6, 79, 94

See application file for complete search history.

(56) References Cited

U.S. PATENT DOCUMENTS

| | | | | | |
|---|---|---|---|---|---|
| 1,509,855 | A | * | 9/1924 | Wadsworth | A44C 5/14 24/265 WS |
| 1,778,313 | A | * | 10/1930 | Darling | A44C 5/246 24/68 E |
| 4,213,548 | A | * | 7/1980 | Wood | A44C 5/0053 224/168 |

(Continued)

FOREIGN PATENT DOCUMENTS

| | | | | | |
|---|---|---|---|---|---|
| CH | 123764 | A | * | 12/1927 | G04B 37/1486 |
| CH | 339876 | A | * | 7/1959 | G04B 37/1486 |
| DE | 508421 | C | * | 9/1930 | G04B 37/1486 |

*Primary Examiner* — Jack W Lavinder

(74) *Attorney, Agent, or Firm* — Lamon Patent Services; Cynthia S. Lamon

(57) ABSTRACT

A bracelet has a metal wrist piece in an arc of a user's wrist, T-bars implemented on opposite ends, each T-bar comprising a round bar of a length substantially the width of the body of the wrist piece, spaced apart from the body of the wrist piece by a T element, a first compound strap of flexible material with a through passage at one end in the direction of the width, a central slot opening into the passage, and a male snap element presented on a surface of the compound strap proximate an end of the strap opposite the through passage, and a second compound strap like the first but with a female snap element. The bars at the ends of the body of the wrist piece are inserted into the through passages through the slots into the through passages, joining the straps to the wrist piece on opposite sides.

14 Claims, 5 Drawing Sheets

(56) References Cited

U.S. PATENT DOCUMENTS

| | | | | | |
|---|---|---|---|---|---|
| 4,307,824 | A * | 12/1981 | Malamoud | G04B 37/1486 | 224/164 |
| 4,639,144 | A * | 1/1987 | Chau | G04B 37/1486 | 224/164 |
| 6,729,159 | B2 | 5/2004 | Rose | | |
| D500,698 | S | 1/2005 | Sanjuro De Vedoya et al. | | |
| D552,003 | S | 10/2007 | Lecut | | |
| D668,996 | S | 10/2012 | Keef | | |
| D849,582 | S * | 5/2019 | Frazzini | D11/3 | |
| 2004/0071048 | A1* | 4/2004 | Ellner | G04B 37/0016 | 368/281 |
| 2014/0000312 | A1* | 1/2014 | Nicolas | A44C 5/2071 | 63/3.2 |

* cited by examiner

ARTICLE OF ADORNMENT WITH INTERCHANGEABLE PARTS

BACKGROUND OF THE INVENTION

1. Field of the Invention

The present invention is in the technical field of wearable articles of adornment such as jewelry and belt fastening, and pertains more particularly to an ornament with unique band attachment sites at opposing ends.

2. Description of Related Art

Bracelets, belt buckles and other jewelry have long been known in the art, but there is always room for innovation to provide articles of adornment that have a different look and feel, and perform functions not formerly known in the art.

BRIEF SUMMARY OF THE INVENTION

In one embodiment of the present invention an article of adornment is provided in the form of a bracelet. Although a bracelet is provided in this embodiment, one with skill understands that one may implement the invention as a bracelet, belt around the waist, an armband or a wearable article of adornment around any part of the body that the article can be affixed to.

In this embodiment the bracelet may comprise a metal wrist piece having a body implemented in an arc of less than 180 degrees, approximating curvature of a user's wrist, the body having a thickness and a width. In this embodiment a body of the wrist piece includes a rectangular shape having a length considerably longer than a width. The metal piece includes T-bars implemented on opposite ends of the length of the body of the wrist piece, each T-bar comprising a substantially round bar element of a length substantially the width of the body of the wrist piece. The T-bars may be separated from the body of the wrist piece by a T element having a width in the direction of the width of the body, yet substantially less that the width of the body.

A first compound strap of flexible material may be provided having a width substantially the width of the body of the wrist piece, a through passage at one end in the direction of the width, a central slot opening into the passage, and a male snap element presented on a surface of the compound strap proximate an end of the strap opposite the through passage. A second compound strap of flexible material may be provided having a width substantially the width of the body of the wrist piece, a through passage at one end in the direction of the width, a central slot opening into the passage, and a female snap element presented on a surface of the compound strap proximate an end of the strap opposite the through passage. One with skill understands that a means for affixing the straps in a loop via the snaps may be done in a variety of ways including stitching, hook and loop, etc. Additionally, one strap may be provided with the single integral strap attaching at each end to a T-bar of the wrist piece. The bars of the T-bars at the ends of the body of the wrist piece are inserted into the through passages through the slots into the through passages, joining the straps to the wrist piece on opposite sides.

In one embodiment the arc has a radius of between 0.75 inches and 2.0 inches inclusive. Also in one embodiment the body of the wrist piece is formed of gold, silver, platinum, copper, titanium, bronze, brass or stainless steel. Alternatively the wrist piece or body of the article of adornment may be manufactured from any rigid material including epoxy, acrylic, wood, glass, crystal, porcelain etc. In one embodiment the body of the wrist piece has decorations on an outer surface. And in one embodiment the decorations comprise miniature renditions of known artifacts. Additionally, the bands may have designs and patterns as well.

In one embodiment the decorations comprise text or graphics in relief. In one embodiment the flexible material is leather. In one embodiment the flexible material is natural or artificial rubber, or a polymer material. In one embodiment the bracelet further comprises a compartment implemented in the body of the wrist piece, enabled to carry small artifacts. And in one embodiment the snap elements are hook and loop fasteners, magnetic clasps, hole and post, and watch-style buckles.

In another aspect of the invention a method of forming a compound flexible fabric strap for a bracelet is provided, comprising cutting a single strap of material of a thickness, width, and length, cutting a first round hole proximate one end of the single strap of material, cutting a second round hole proximate an opposite end of the single strap of material, such that the ends with the holes cut are mirror images, cutting a through slot of a length substantially shorter than the strap length, the through slot centered on the width of the strap, and spanning a midpoint of the length of the single strap, folding the single strap of material lengthwise about the midpoint of the strap length, joining the ends together, matching the round holes through the strap, inserting opposite portions of a snap element into the round hole and engaging and securing the snap element in the hole, and stitching the two regions together, forming a through passage in a direction of the width at an end furthermost from the snap elements, with the slot providing an entrance into the through passage.

In one embodiment the method further comprises cutting two round holes proximate one end of the single strap of material, and inserting two snap elements from below through the two round holes. In one embodiment the flexible material is leather. And in one embodiment the flexible material is natural or artificial rubber, or a polymer composite.

DETAILED DESCRIPTION OF THE INVENTION

Figure 1:
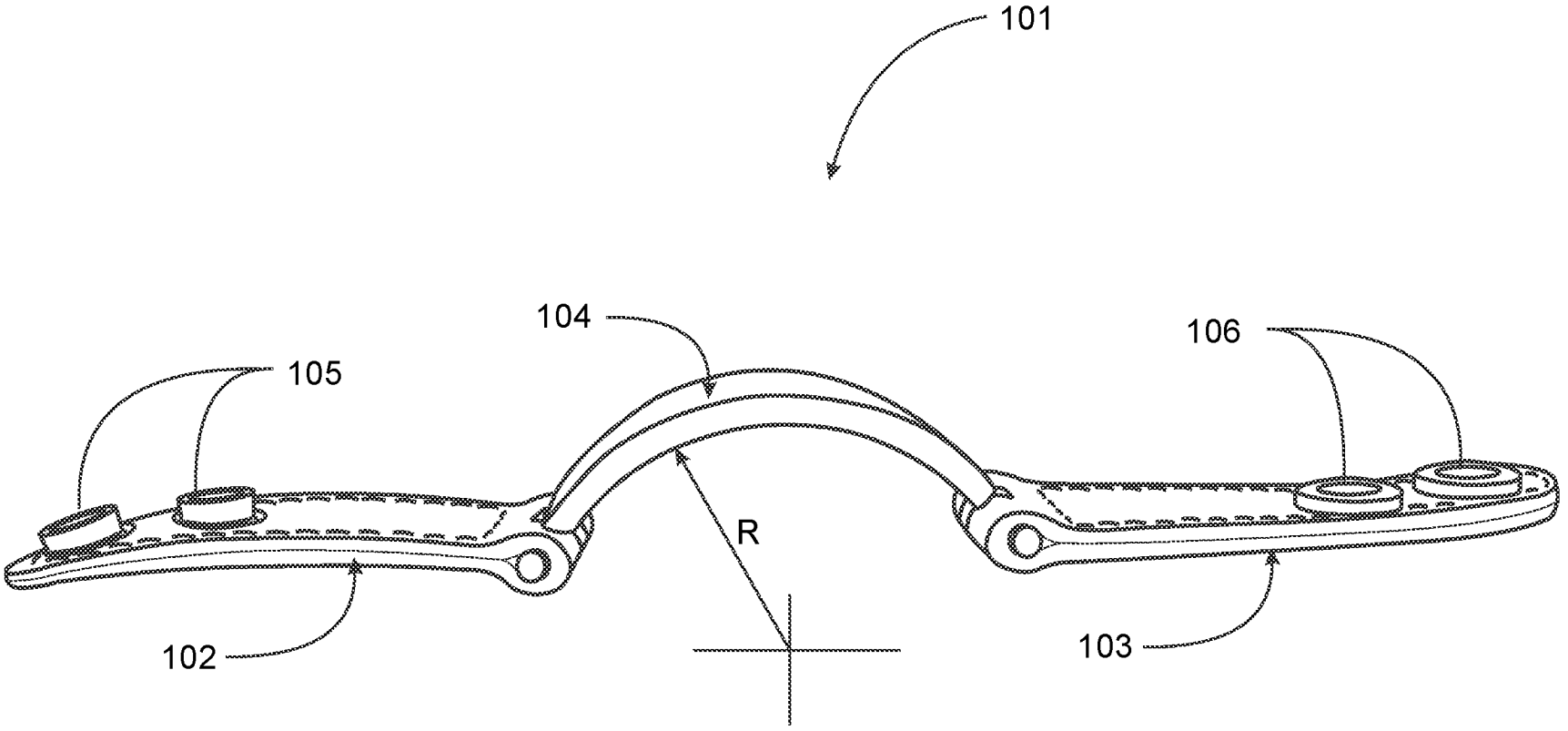
FIG. 1 is a perspective side-elevation view of a bracelet according to an embodiment of the present invention.
Figure 2:
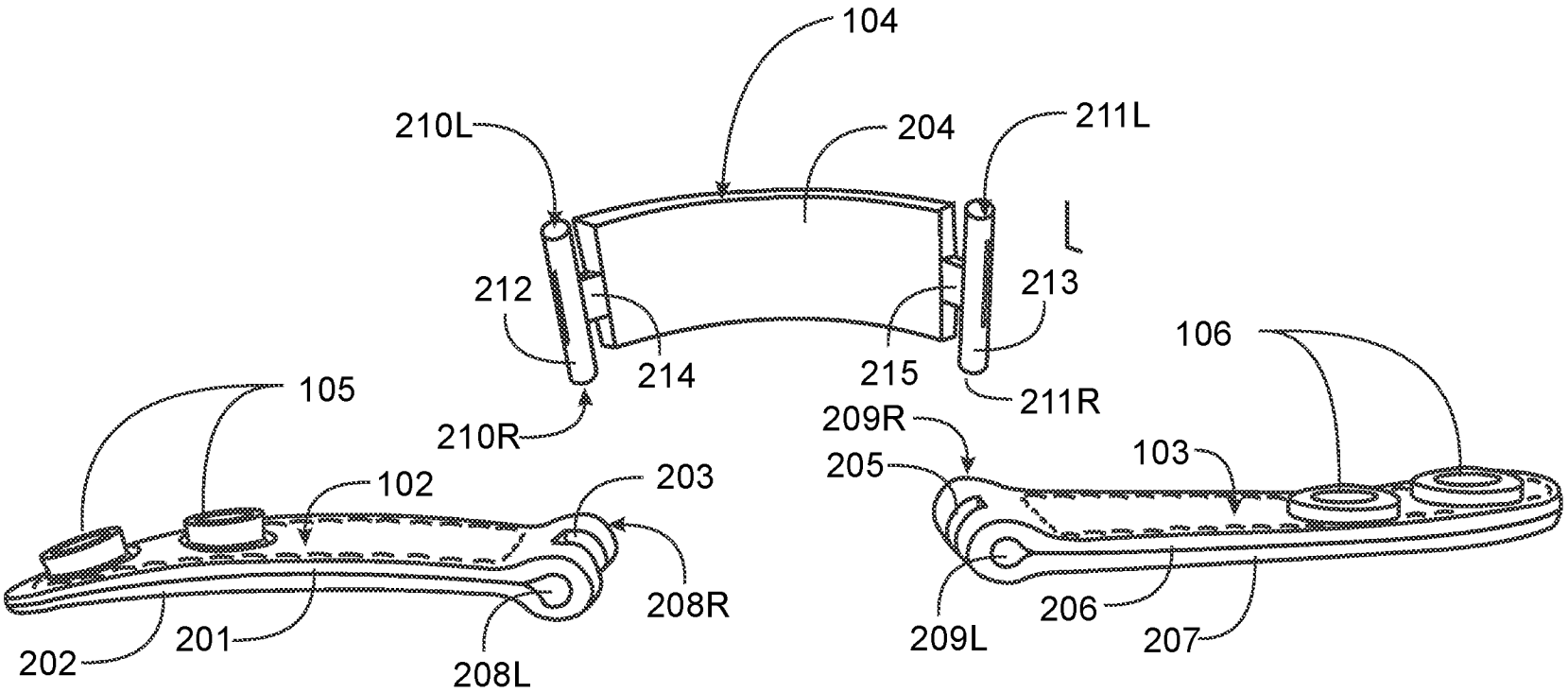
FIG. 2 is a partially exploded view of the bracelet of FIG. 1.
Figure 3A:
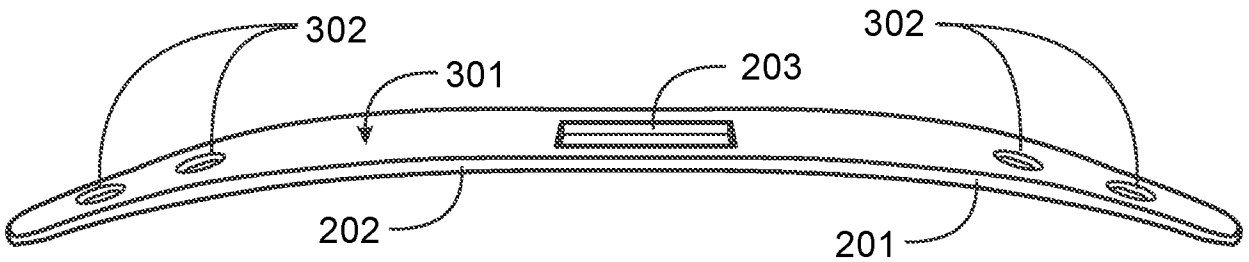
FIG. 3A is a flattened view of a leather strip for forming a strap element for the bracelet of FIGS. 1 and 2.
Figure 3B:
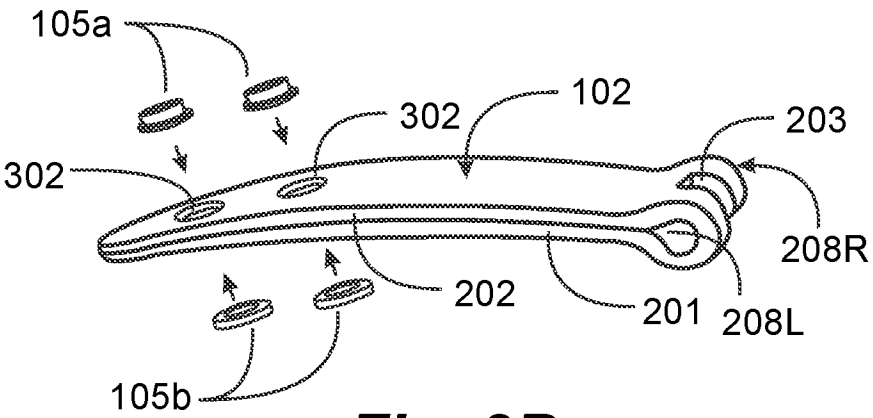
FIG. 3B is a side view of the strip of FIG. 3A folded to insert snap elements.

FIG. 1 is a perspective side-elevation view of a bracelet 101 according to an embodiment of the present invention. FIG. 2 is a partially exploded view of the bracelet of FIG. 1. FIG. 3A is a flattened view of a leather strip for forming a strap element for the bracelet of FIGS. 1 and 2. FIG. 3B is a side view of the strip of FIG. 3A folded for inserting snap elements.

Referring to FIG. 1, bracelet 101 comprises a relatively heavy metal wrist piece 104 shaped in an arc with a radius R that may vary in different embodiments according to the shape and size of a wearer's wrist. In one embodiment R may be about 1 inch to conform comfortably to a wrist of a user. R may in some embodiments be as much as 2.0 inches, or as small as 0.75 inches, but will typically be in this window. The arc length of the wrist piece or body 104 is generally about 115°-120°, but may be somewhat more or less in some embodiments, naturally adjusting this measurement depending on the radius and central angle.

Wrist piece 104 has a T-Bar implemented at each end of the arc of the wrist piece, the T-Bars are not seen in FIG. 1, but are shown in detail in FIG. 2 and described in enabling detail below with reference to FIG. 2.

Bracelet 101 has a compound leather strap 102 joined to the T-Bar at one end of the wrist piece, and a compound leather strap 103 joined to the T-Bar at the opposite end of the wrist piece. Leather strap 102 includes two male snap elements 105 in this example, and leather strap 103 has two female snap elements 106, compatible with snap elements 105, such that the wrist piece may be placed on a wearer's wrist, and the compound leather straps may be formed around the wrist, and the snap elements joined, to secure the bracelet on the wearer's wrist. The dual snaps serve to more efficiently secure the bracelet onto a wrist, for example.

Referring now to FIG. 2, wrist piece 104 is shown disengaged from leather strap elements 102 and 103, and rotated somewhat around a horizontal axis, to better illustrate T-Bar elements. The T-Bar 5 elements comprise generally round bars 212 and 213, affixed to each end of a body 204 of the wrist piece by T elements 214 and 215, such that the bars are spaced apart from the end of the wrist piece by common length of the T elements 214 and 215. T elements 214 and 215 serve to space the T bars 212 and 213 from the body 204. Depending on a thickness of material of the straps, the common length of T elements 214 and 215 may be adjusted to be longer thereby accommodating a thicker strap material, or shorter to accommodate a thinner material of the straps. As clearly seen in FIG. 2 the width of the T-bar exceeds a width of the body.

Also referring to FIG. 2, one end of each of leather straps 102 and 103 is formed in a shape that present passages 208L, 208R, 209R and 209L in a direction orthogonal to the length of the strap, such that bar ends 210L, 210R, 211R and 211L may engage the passages via slots 203 and 205. The passages 208 and 209 are intersected by slots 203 and 205 to accommodate T elements 214 and 215.

Referring now to FIG. 3A, a single strip of leather is shown as element 301. In some embodiments the strip of leather may be comprised of two or more layers of fabric or leather. This strip, with male snap elements installed, becomes compound strap 102 as seen in FIG. 1 and FIG. 2. Region 202 has two through holes 302 punched as shown, and region 201 also has two through holes 302 punched to be at common spacing and position in mirror image to region 202.

The inventor is aware of the problems of placing toxic materials such as chromium processed leather and chrome plated metal next to the skin, so care is taken to provide materials that do not irritate the skin or introduce toxins. For example strap 301 may be manufactured from one or more layers of material, such as leather, wherein a layer of vegetable tanned leather would be overlaid, either partially or entirely, over portion 201 in order to protect a wearers skin. In some embodiments layered portions of the leather making up straps 301 may be removed leaving a leather strap of a thinner dimension, allowing a layer of vegetable tanned leather or an ornamental material to be glued or otherwise affixed enabling a strap of uniform thickness. In other embodiments an extension of a different material may be added to strap ends prior to folding over and stitching/gluing. This is done by removing an inner portion of the existing leather strap leaving a top and bottom layer, inserting the new material between the layers, enabling the layers to overlap the new material by ¼ to ½ inch and gluing in place. Then folding the strap over to glue and stich closed.

FIG. 3B illustrates strip 301 folded about center with through holes 302 on each end matched and aligned. Snap elements 105 of FIG. 3 are shown in FIG. 3 as elements 105*a* and 105*b*, which are assembled through holes 302 and engaged and clinched, similar to rivets, as is known in the art, forming male snap elements 105 assembled through the two layers of leather. After the snap elements are assembled to the folded strap, regions 201 and 202 are stitched together as shown in FIG. 1, forming the compound strap 102 with passages 208L, 208R and slot 203. In an alternative embodiment, regions 201 and 202 are glued and/or stitched together prior to the snap assembly being inserted and affixed.

Strap 103 is produced in essentially the same way as strap 102, except female snap elements 106 are assembled through the holes 302 after folding and before stitching. In another embodiment stitching and gluing occurs prior to inserting the snap elements. Once the straps are produced, the wrist piece 104 is assembled to the straps, or the straps are joined to the wrist piece.

In one embodiment, the wrist piece may be engaged as the folding and stitching takes place, but preferably, the wrist piece is assembled to each strap by passing first one end 211L of the bar 213 into passage 209L via slot 205, and then stretching the leather (or other flexible strap material) to get the other end 211R of the bar 213 into passage 209R via the slot 205. Additionally, bar end 210L of bar 212 enters passage 208L via slot 203 and bar end 210R enters passage 208R via slot 203. This procedure enables a user to substitute different wrist pieces into a bracelet, to change the nature and characteristics of the bracelet for different occasions, and to put straps of different color, texture and material onto wrist pieces.

In FIGS. 1 and 2 wrist piece 104 is illustrated as a metal bar of approximately rectangular cross-section, and this may be the finished characteristic in some embodiments. For example, in one embodiment the metal wrist piece may be gold, and gold of different color and alloy in different embodiments. In other embodiments the metal may be silver, or stainless steel. In other embodiments there may be specific decoration on the outer surface of the wrist piece, such as gear teeth, either straight or at an angle. Text and graphics may be presented in relief on wrist pieces in different embodiments as well.

The inventor believes the T-bar construction and the nature of the leather straps provide a functional interface enabling a user to present a variety of different sizes and appearances in a bracelet, specifically flexibility with interchangeable strap and ornament arrangements.

Figure 4:
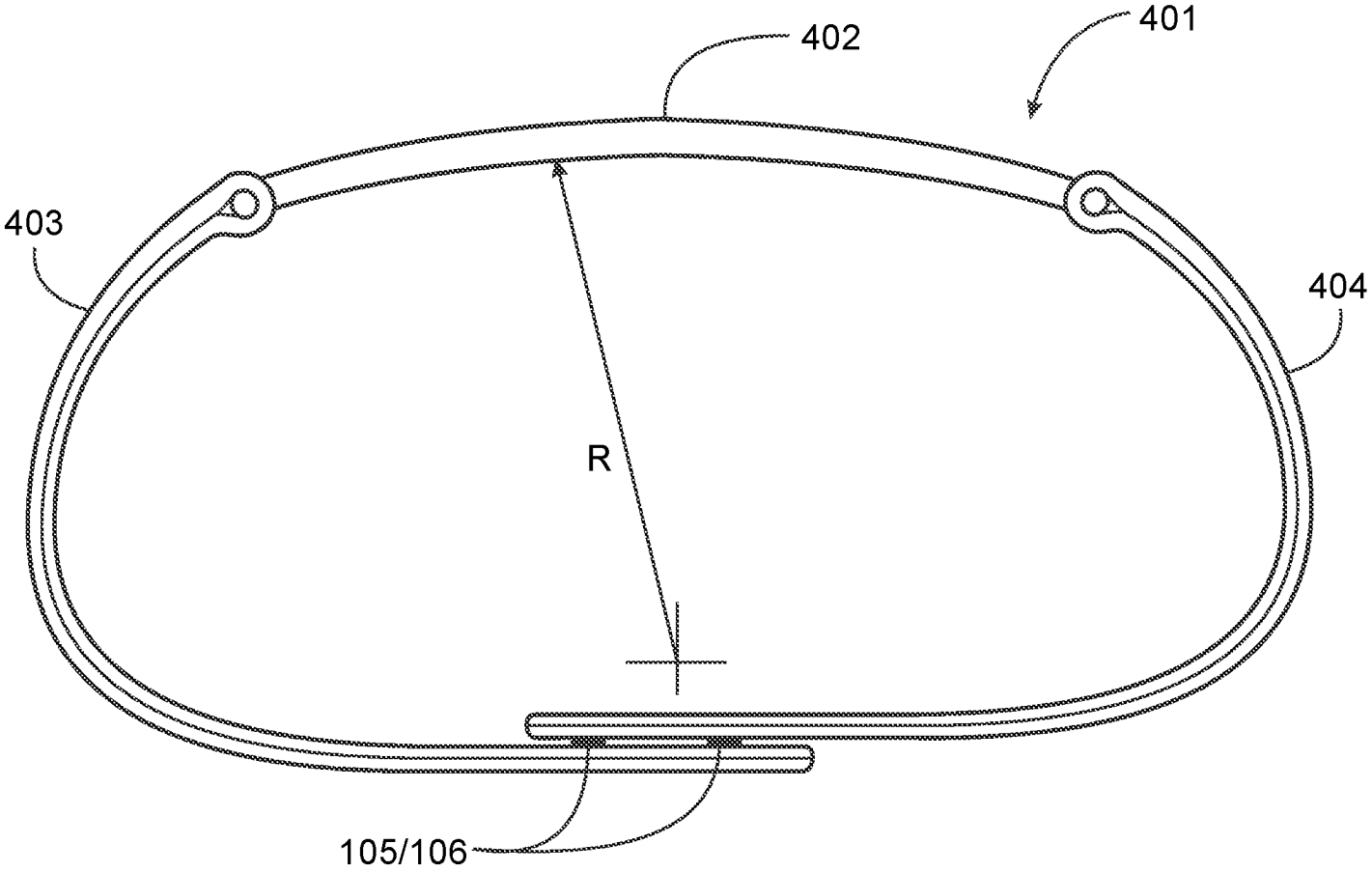
FIG. 4 is a edge-on plan view of a belt and body apparatus according to an embodiment of the present invention.

FIG. 4 is an edge on plan view of a belt and body apparatus according to an alternative embodiment of the present invention. Body 402 in this example may be referred to as a buckle, as it occupies the place of a buckle when in use, but does not have a buckle function, as is usually understood in the art. Instead, body 402 may be a decorative body, such as the sort of buckle awarded to prize fighters, for example. Body 402 may be provided in a variety of sizes, and with a variety of decorative finishes for a variety of purposes. Body 402 may have a length of between 1 and 10 inches. It is formed in a radius R that conforms to a curvature of the front area of a users abdominal region, where a belt buckle is expected to be. It may at first seem that the center for radius R is incorrect, but this is simply because the cross-section of a human body is not circular (for most people) but is oval.

Regardless of the arc length, height, or decoration for body 402, there are T-bars at each end in the fashion of T-bars 212 and 213 attached at each end of body 402. Body 402 assembles by the T-bars to belt portions 403 and 404, which are constructed similarly to bands 102 and 103 described above. That is, one strip of leather or other suitable material, of suitable length, is folded over glued and/or stitched and snap fasteners installed, to form a belt portion with male snap elements at one end and a through passage at the other end to accept a T-bar of the body. A second belt portion is assembled and prepared using female snap elements and the two belt portions are joined to the body by the T-bars, just as for the bracelet described above. It will be apparent to the skilled person that the belt portions may be of any length and width, and a multitude of methods may be used to join the two ends such as hook and loop, magnetic clasp, watch type buckle and one or more snap fasteners may be installed to secure the belt.

Figure 5:
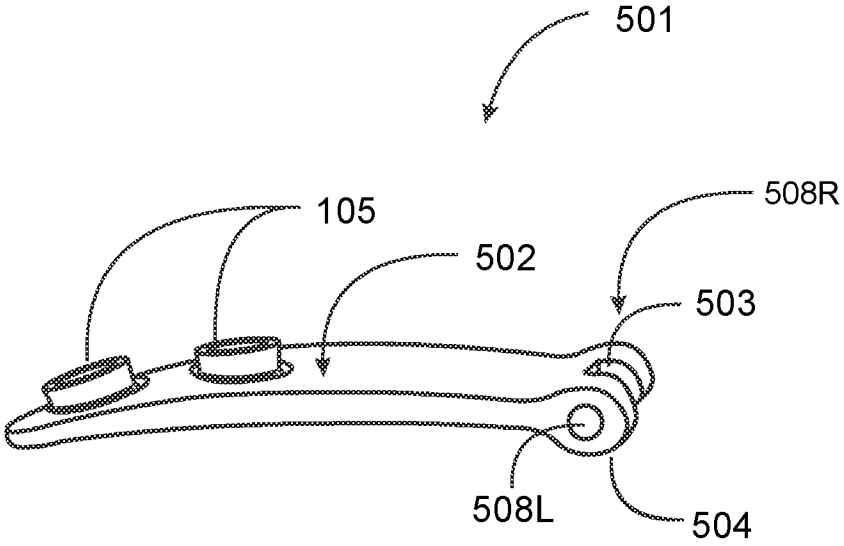
FIG. 5 is an elevation view for an alternative strap.

FIG. 5 is a perspective view of a band assembly 501 in an embodiment of the invention, wherein the band is made in a different manner than bands 102 and 103 of FIG. 1. Band assembly 501 comprises a molded band 502 with snap fasteners 105. In this example band 502 is molded from rubber, artificial rubber, or any suitable flexible material, such as a polymer material, in one piece. There is no need to fold and stitch to complete the assembly. In some cases the rounded end 504 with through passage 508L and 508R. Slot 503 may be formed in the molding process, and in some cases they may be formed after molding in a machining operation, for example. The same is true for holes to accommodate snap elements, which may be either formed in molding or punched after molding.

It will be apparent to the skilled person that the molding process for the bands for a bracelet may be also used for belt portions to make a belt assembly as illustrated in FIG. 4.

The skilled person will understand that there may be a variety of alterations to embodiments of the invention described herein, without departing from the scope of the invention. For example, the strap material is not limited to leather, but may be other materials, such as natural or artificial rubber, or any one of a number of polymer materials. The snap elements described are not limiting as well, as there are a variety of snaps and hook and loop fasteners that might be used. In one embodiment magnets, magnetically permeable materials and watch-style buckles may be employed to secure the straps to a user's wrist. There may further be variations in the length and diameter of the bars in the T-bars, and there may be differences in the way that the T elements are joined to the body of the wrist piece and to the bars of the T-bars. In some embodiments an indention or a compartment may be provided in either the topside or the underside of the body of the wrist piece, for a user to carry any number of small items. In some embodiments a lens may be provided over a compartment and a light implemented within, and there may be provision for power for the light and for switching a light off and on. There are many such possible alterations within the scope of the invention.

I claim:

1. A bracelet, comprising:

a metal wrist piece having a body implemented in an arc length of less than 180 degrees, approximating curvature of a user's wrist, the body having a thickness and a width;

T-bars integrated with and implemented on opposite ends of the body of the wrist piece, each T-bar comprising a substantially round bar element of a length exceeding the width of the body of the wrist piece, spaced apart from the body of the wrist piece by a T element;

a first compound strap of flexible material having a width substantially the width of the body of the wrist piece, a through passage at one end in the direction of the width, a central cutout having a width to accommodate the T-bar, the cutout opening into the passage, and a male snap element presented on a surface of the compound strap proximate an end of the strap opposite the through passage; and a second compound strap of flexible material having a width, a through passage at one end in the direction of the width, a central cutout opening into the passage, and a female snap element presented on a surface of the compound strap proximate an end of the strap opposite the through passage;

wherein the round bar elements are each connected at the opposite ends of the body of the wrist piece via the T element and each round bar element is inserted through the cutout into the through passage of one of the first and second compound strap, joining the straps to the opposite ends of the wrist piece.

2. The bracelet of claim 1 wherein the arc has a radius of between 0.75 inches and 2.0 inches inclusive.

3. The bracelet of claim 1 wherein the body of the wrist piece is formed of metal including any one of gold, silver, platinum, bronze, copper, brass, titanium and stainless steel.

4. The bracelet of claim 1 wherein the body of the wrist piece has decorations on an outer surface.

5. The bracelet of claim 4 wherein the decorations comprise miniature renditions of known artifacts.

6. The bracelet of claim 4 wherein the decorations comprise text or graphics in relief.

7. The bracelet of claim 1, wherein the width of the flexible material is less than the width of the body.

8. The bracelet of claim 1, wherein the width of the flexible material is greater than the width of the body.

9. The bracelet of claim 1 wherein the flexible material is leather.

10. The bracelet of claim 1 wherein the flexible material is natural or artificial rubber, or a polymer material.

11. The bracelet of claim 1 comprising a compartment implemented in the body of the wrist piece, enabled to carry small artifacts.

12. The bracelet of claim 1 wherein the snap elements are hook and loop fasteners.

13. The bracelet of claim 1 wherein the snap elements are a watch-style buckle.

14. The bracelet of claim 1 wherein the snap elements are a magnetic clasp.

* * * * *